United States Patent [19]

Amneus

[11] 4,163,509

[45] Aug. 7, 1979

[54] SQUEEZE DISPENSER WITH SELF CLOSING VALVE

[75] Inventor: John S. Amneus, Cincinnati, Ohio

[73] Assignee: The Procter & Gamble Company, Cincinnati, Ohio

[21] Appl. No.: 889,460

[22] Filed: Mar. 23, 1978

Related U.S. Application Data

[63] Continuation-in-part of Ser. No. 836,117, Sep. 23, 1977, abandoned, said Ser. No. , is a continuation-in-part of Ser. No. 770,533, Feb. 22, 1977, abandoned.

[51] Int. Cl.[2] ..... B65D 35/08; B65D 35/52

[52] U.S. Cl. ..... 222/95; 137/846; 222/105; 222/494; 222/541

[58] Field of Search ..... 222/103, 107, 207, 491, 222/494, 528, 530, 541, 95, 99, 105, ; 137/846, 847, 850; 264/248

[56] References Cited

U.S. PATENT DOCUMENTS

| | | | |
|---|---|---|---|
| 2,554,050 | 5/1951 | Neubeck | 222/528 X |
| 3,224,640 | 12/1965 | Schneider et al. | 222/107 |
| 3,278,085 | 10/1966 | Brown | 222/107 |
| 3,439,846 | 4/1969 | Evras | 222/494 |
| 3,604,595 | 9/1971 | Wiedeman | 222/99 |
| 3,815,794 | 6/1974 | Carlisle | 222/491 |
| 3,878,977 | 4/1975 | Carlisle | 222/491 |

FOREIGN PATENT DOCUMENTS

| | | | |
|---|---|---|---|
| 1947172 | 5/1970 | Fed. Rep. of Germany | 222/530 |
| 1482872 | 6/1967 | France | 222/95 |

*Primary Examiner*—David A. Scherbel
*Attorney, Agent, or Firm*—E. Kelly Linman; John V. Gorman; Richard C. Witte

[57] ABSTRACT

A dispensing container has a spout formed of opposing walls of supple, imperforate material joined along their side edges with at least a portion thereof being formed over a curved surface. The aforementioned portion of the spout is thus set in a curled condition in the direction of discharge with the walls in face-to-face contact to effect a valving action. The spout can include a metering chamber to permit a desired quantity of fluid contents to be separated and milked through the curled portion to the discharge end of the spout. If desired, the entire dispensing container can be similarly formed over a curved surface so that the empty end of the container opposite the spout will also assume a curled conformation as the container's contents are discharged through the spout.

12 Claims, 10 Drawing Figures

SQUEEZE DISPENSER WITH SELF CLOSING VALVE

CROSS-REFERENCE TO RELATED APPLICATION

This application is a continuation-in-part of co-pending application Ser. No. 836,117 filed Sept. 23, 1977 in the name of the present applicant, and now abandoned, said copending application being a continuation-in-part of application Ser. No. 770,533, filed Feb. 22, 1977 in the name of the present applicant, and now abandoned.

BACKGROUND OF THE INVENTION

1. Field of the Invention

This invention relates to fluid dispensers and, more particularly, to dispensers having a self-closing valve thereon.

2. Description of the Prior Art

Pouch type dispensers with self-closing valves are well known, as shown in Carlisle, U.S. Pat. No. 3,815,794, issued on June 11, 1974, wherein a spout which is flat when empty is so configured that it forms a seal thereacross when distended by contained fluid. A somewhat similar result is achieved in a dispenser having a flat spout by following the teachings of Fohr, U.S. Pat. No. 3,009,498, issued Nov. 21, 1961, wherein the ratio of width of the spout to the pouch body appears critical to establish the seal. U.S. Pat. No. 2,517,027 issued to Rado on Aug. 1, 1950 discloses still another tube-like dispensing container provided with a self-sealing aperture. The longitudinally extending neck portion at the top of the tube is narrower than the width of the tube, said neck portion being formed by a pressing and drawing action whereby its medial portion is under great elastic strain, thereby tending to resist any bending movement thereof. A slit is preferably made in the neck portion at right angles to the longitudinal dimension of the neck, whereby upon bending the neck in a direction opposite to the side of the tube where the slit is made the contents of the tube may be expelled by applying pressure to the tube walls. Such dispensers, however, have dimensional parameters which must be followed in order to have the valve action properly work and, thus, are somewhat restrictive in connection with the design of dispensing pouches. Furthermore, dispensers of the type disclosed in the patent to Rado require simultaneous bending and squeezing actions to initiate dispensing, thereby necessitating the use of both hands. Moreover, a self valving action of somethat improved reliability over that of the Carlisle, Fohr and Rado valves is desirable.

It is also known to provide a package with a nozzle which is in rolled condition when not in use and which unrolls and permits the package contents to be expressed therethrough when pressure is applied to the package. This is shown in Evras, U.S. Pat. No. 3,439,846, issued Apr. 22, 1969, in which the nozzle is described as a flat flexible tube which inherently returns to a collapsed condition and which can be aided by a spring when dense products are to be dispensed.

SUMMARY OF THE INVENTION

In accordance with one aspect of the present invention there is provided a dispensing container having an outwardly projecting discharge spout. The discharge spout is made of opposing walls of supple imperforate material interconnected along its lateral edges by seams.

The walls are face-to-face when the spout is empty. The spout has a valve portion in which the walls are maintained in a curled conformation in the discharge direction. The walls of the valve portion are separate layers of the material and these are united with corresponding elements offset in the discharge direction because of the curled conformation.

In accordance with still another aspect of the present invention, both the valve spout and the body of the dispensing container are formed about a curved surface in the manner described above. A slotted gate member is preferably applied to the end of the container opposite the spout to keep the contents of the container taut without opening the curled valve portion. The slotted gate member which is slidable along the length of the container exhibits sufficient friction against the body of the container that it remains in place even when the taut container is squeezed to express product through the valve portion. When the squeezing ceases, the discharge end of the container becomes flaccid and the valve reassumes its curled conformation, thereby closing. The slotted gate member may thereafter be advanced toward the valve an amount sufficient to restore the container to a taut condition, thereby refilling the spout portion. The portion of the container passed through the slotted gate member curls up automatically because the fin seal on either side of the container was made while the stock comprising the container body was wrapped around a cylindrical mandrel.

In accordance with another aspect of the present invention, there is provided a method of constructing a valve in a spout made of separate opposing walls of supple, imperforate material. In a particularly preferred embodiment, the body of the dispensing container is also made of separate opposing walls of supple, imperforate material. In the latter method, the walls comprising the valve and the body of the dispensing container are held in face-to-face contact, formed over a curved surface and the walls seamed along the entire length of the container while maintained in the curved condition.

Figure 3:
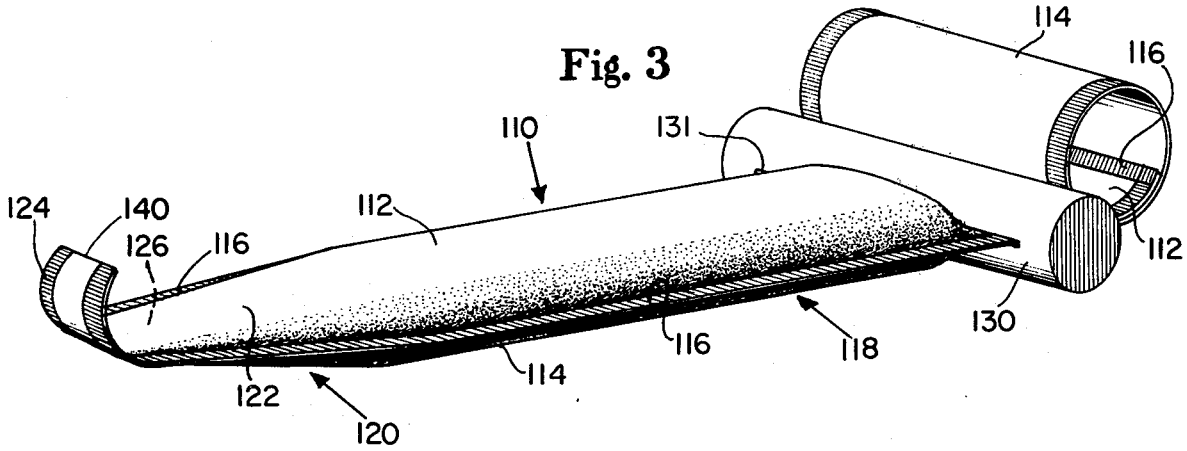
FIG. 3 is a perspective view of an embodiment of the present invention wherein the shipping seal located at the discharge end of the container has been opened to dispense product, said embodiment being formed so that both the valve portion of the spout and the empty portions of the container body opposite the spout assume a curled conformation.
Figure 4:
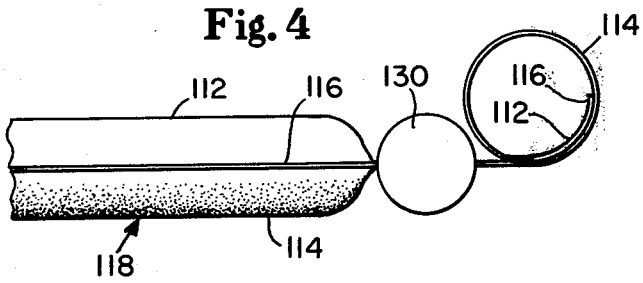
FIG. 4 is a partial side elevation view of the container illustrated in FIG. 3.
Figure 8:
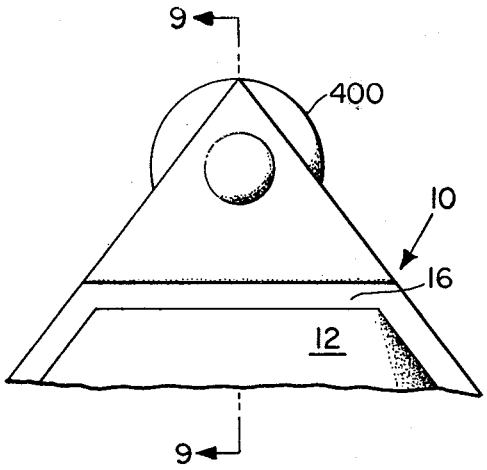
FIG. 8 is a partial front elevation of a dispensing container of the type generally illustrated in FIGS. 1 and 2 equipped with a suction cup for suspending the container in use.
Figure 9:
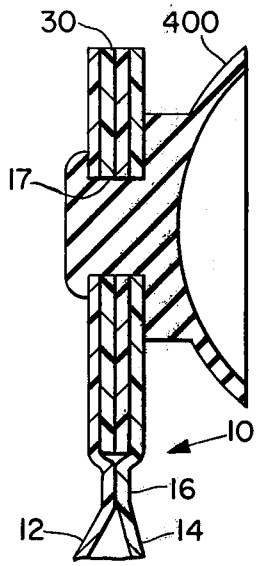
Figure 10:
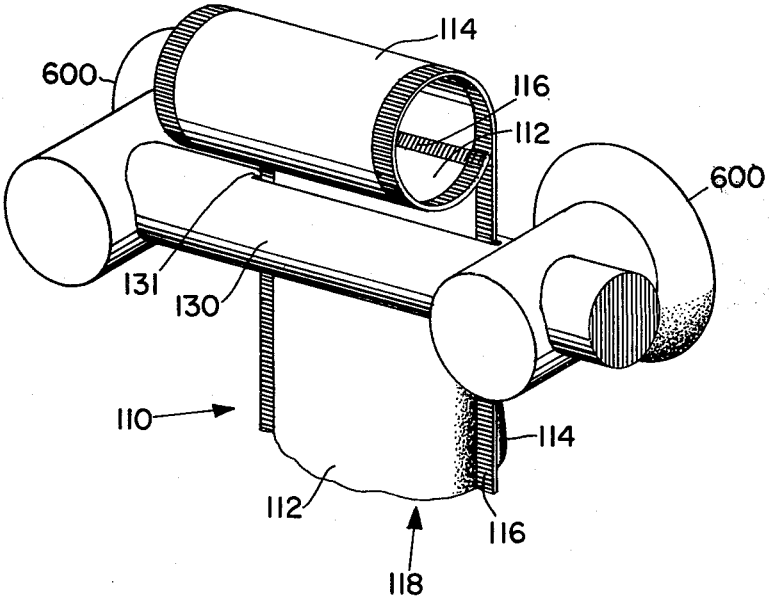

FIG. 9 is a cross-sectional view of the dispensing container of FIG. 8 taken along section line 9—9 of FIG. 8; and FIG. 10 is a partial perspective view of an embodiment of the present invention of the type generally illustrated in FIGS. 3 and 4 equipped with a pair of suction cups for suspending the container in use.

DESCRIPTION OF THE PREFERRED EMBODIMENT

Referring to the Figures, there is shown a fluid dispensing container 10 of the present invention filled with fluid contents, particularly liquids and gels. The container 10 comprises opposing walls 12, 14 of supple, imperforate materials which are joined peripherally by seams 16. Above the seam 16 across the top of container 10, a perforation 17 can be used to provide the means by which the package can be hung in use. It is of course recognized that many other integral suspensory means well known in the art could be provided for this purpose, i.e., suction cup, 400 secured in perforation 17 of dispensing container 10 as shown in FIGS. 8 and 9 etc. Container 10 comprises a body 18 of any desired shape and an outwardly projecting discharge spout 20. The discharge spout 20 has a metering chamber 22 adjacent the body 18 and a valve portion 24, in which the walls are biased into a curled conformation in the discharge direction when fluid is not being discharged therethrough.

The curled conformation is maintained by the peripheral seams 16, which are applied in the valve area while the walls 12, 14 comprising the valve portion 24 are in face-to-face contact and formed over a mandrel or other curved surface. When so formed, corresponding elements of walls 12, 14, i.e., those which would coincide if the valve portion were held in face-to-face flat condition, are offset in the discharge direction by reason of the curled conformation. The offset, of course, is due to the fact that the radius of curvature of the wall 14 is greater than that of wall 12 in the valve portion. It is in the thus offset relationship that the union of the separate walls 12, 14 in the valve portion is effected along seams 16. The seams 16 in the balance of the discharge spout 20 and body 18 can, if desired, be formed while the walls 12, 14 from which they are made are face-to-face and flat.

Thus, prior to filling, the walls 12, 14 can be joined, seamed, along the sides of the body 18 and along the sides and end of spout 20, with the valve portion 24 held curled and the balance of the container 10 flat. Then a filling nozzle (not shown) can be inserted between the walls 12, 14 at the top of the container 10, the fluid to be packaged injected into the container 10, the filling nozzle retracted and the walls 12, 14 thereafter sealed across the top to complete the package. If perforation 17 is used, this can be made after the top seal 16 is effected.

The materials comprising walls 12, 14 can be the same or different, so long as seams 16 interconnecting them at their lateral edges can be made. Desirably such materials are flaccid, i.e., supple, imperforate, somewhat elastic, compatible with the fluid to be placed in the container 10 and heat-sealable. Examples of suitable films include polyethylene, polypropylene, polyvinyl chloride and laminates of polyester and a heat seal coating in thicknesses which are appropriate, depending on variables such as the specific gravity and viscosity of the contained fluid, the width of the discharge passageway 26 through the spout of the valve portion and the amount of curl set in the valve portion.

The seams 16 can be made in any manner known to those skilled in the art. For example, the seams 16 may be made with heat sealing jaws shaped to the outline of the container 10 when the walls 12, 14 are heat-sealable. Optionally, the seams 16 can be made by an adhesive applied to the edge portions of walls 12, 14 which are cut to shape. Alternatively, the seams 16 can be made by a contoured hot wire. Preferably, however, the seam 16 is of the fin type so that the seams 16 in the valve portion of the spout are approximately the thickness of the combined walls 12, 14. This would provide seams of greater resilience than that of a single layer, to thereby increase forces biasing the valve to a curled condition when using thin films.

The metering chamber 22 located within the spout 20 can be of any desired shape. For example, the seams 16 defining chamber 22 can converge, as shown, in the discharge direction to form an inverted generally conically shaped discharge passageway 26 therethrough when the same is distended with the contained fluid. Alternatively, they can be parallel so that the upper part of discharge passageway 26 is cylindrical when filled. In any case, it is desirable to size the passageway 26 so that product can be stripped from therewithin by tactile manipulation without great effort. For example, the passageway 26 width when flat can conveniently range from between about $\frac{1}{8}''$ to about $\frac{5}{8}''$, depending on the application.

Within the valve portion 24 of the discharge spout 20 the passageway 26 can be shaped and sized as described above in connection with the metering chamber 22. At the discharge end 28 of spout 20, the seams 16 converge in the discharge direction and are initially interconnected with one another in order to close said passageway 26 off, thus forming a shipping seal. The consumer can open the sealed container 10 by cutting across the spout at various locations on the tapered passageway 26 near the discharge end 28 to form an outlet of desired size.

Figure 6:
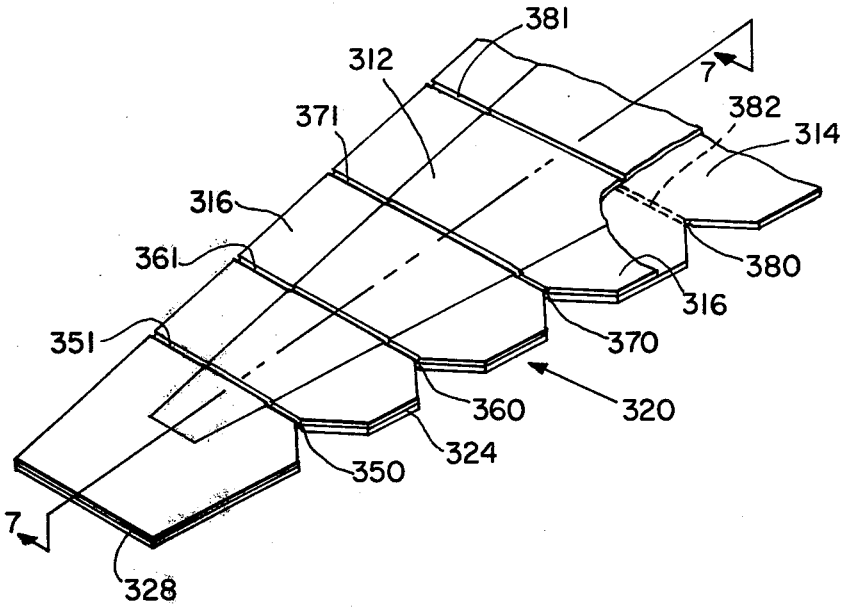
FIG. 6 is a partial perspective view of an embodiment of the present invention including means for manually opening the shipping seal.
Figure 7:
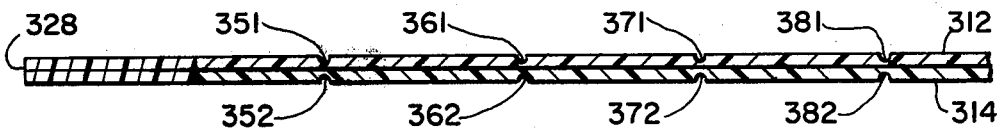
FIG. 7 is an enlarged cross-sectional view taken along section line 7—7 of FIG. 6.

In the alternative embodiment shown in FIGS. 6 and 7, which for the convenience of illustration is shown in the uncurled configuration, means for manually tearing open the sealed end 328 of a curled valve 324 of the present invention may comprise one or more notches 350, 360, 370, 380 or other type of stress concentration located at predetermined points along an edge of at least one of the outermost converging seams 316 of the spout 320. Such pre-spaced stress concentrations enable the consumer to select the desired outlet size by initiating a tear at the chosen stress concentration, which tear propagates across the width of the spout to form a discharge outlet without need for a cutting implement. If desired, score lines such as 351, 352, 361, 362, 371, 372, 381, 382 or other lines of weakness extending across the entire width of the spout 320 can be provided in the outermost surfaces of each of the container walls 312, 314 adjacent each stress concentration. Such lines of weakness facilitate uniform tearing of the container walls 312, 314, thus ensuring that product will be cleanly discharged from the outlet when the package is squeezed.

Figure 1:
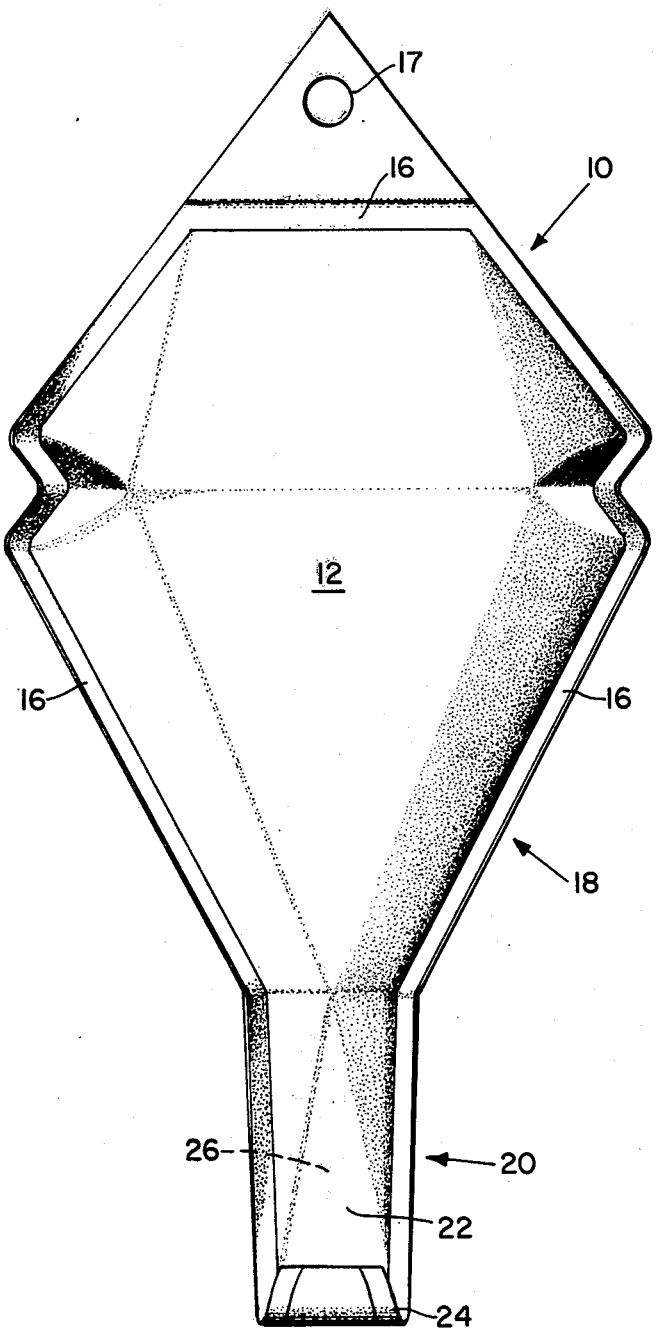
FIG. 1 is a front elevation of a dispensing container of the present invention.
Figure 2:
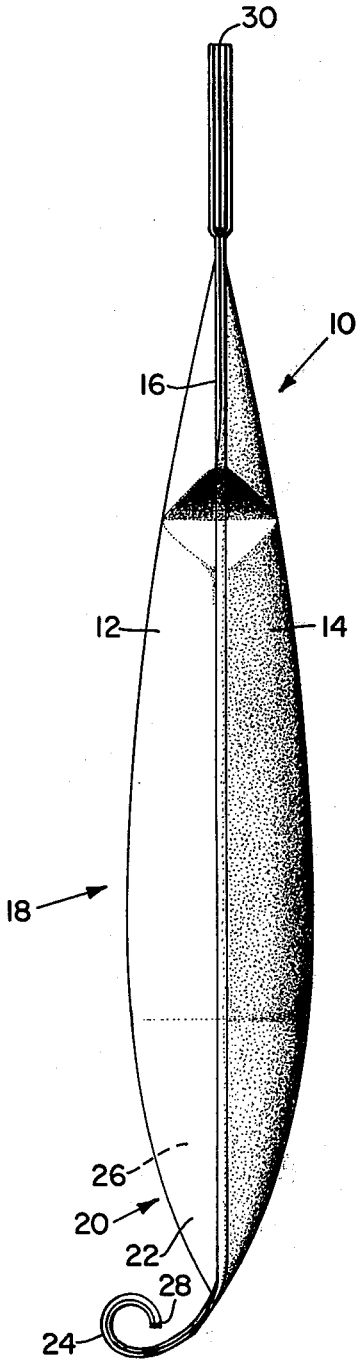
FIG. 2 is a side elevation of the dispensing container of FIG. 1.

As stated above with respect to the embodiment of FIGS. 1 and 2, the seams 16 in the valve portion 24 of discharge spout 20 are made while the portion 24 is held in a curled condition. For example, the portion 24 can be wrapped tightly around a cylindrical mandrel, not shown, the axis of which is generally normal to the axis of passageway 26 and, thus, to the centerlines of the spout 20 parts of the walls 12, 14. Then, while the portion 24 remains wrapped and the walls 12, 14 in face-to-face contact, the seals 16 can be made in the desired manner. This causes the walls 12, 14 in the valve portion 24 to be set in the curled conformation, wherein it can seal the passageway 26 below the metering chamber 22. If product is later forced into the passageway 26 in the valve portion 24, however, this will cause the walls 12, 14 therein to separate and the valve portion to straighten somewhat and thereby permit dispensing. In such condition, the structure of the valve portion 24 is acted upon by stresses, following dispensing, which bias it to the relaxed curled conformation with the plies face-to-face to re-establish the seal.

An example of a satisfactory embodiment of the present invention was made as a package 10 for dispensing a shampoo product having a viscosity of about 24,000 cp. The material comprising the walls 12, 14 was a polyester-heat seal laminate sold by the 3M Company of St. Paul, Minn. under the trademark Scotchpak #48 and having a thickness of about 0.0045". Scotchpak #48 is a laminate of ½ mil of a homopolymer, polyethylene terephthalate, and 4 mils of medium density polyethylene (density about 0.93). The container 10 in its unfilled, flat condition had a body 8 of a shape similar to that of the filled pouch shown in FIGS. 1 and 2 and measured approximately 4" across and 5" in height. The spout 20 had a metering chamber 22 approximately 1½" long, the passageway 26 of which was about 1⅛" wide adjacent the body and ⅝" wide adjacent the valve portion 24. The valve portion 24 was about 1" long, with a passageway 26 tapering down to about ⅜" adjacent the discharge end 28. In forming the container 10 the valve portion 24 was held wrapped abut the periphery of a ¼" diameter cylindrical mandrel, the axis of which was generally normal to the axis of passageway 26, for seaming. The seams 16 along the sides of the body 18 and around the spout 20 were made with heat sealing jaws and had a width of about 3/16". The top was sealed with a 3/16" seam and the materials of the container 10 thereabove were reinforced by laminating one or more extra plies of material 30 therebetween. A ⅜" perforation 16 was made through that area to permit the package 10 to be suspended from a shower hook or other supporting means.

In use, the discharge end 28 is cut off at a desired location to open up discharge passageway 26. Next, the container 10 is suspended, as from a shower hook, whereby the fluid pressure of the contents distends the package as shown. The user, employing his index finger and thumb pinches off the desired amount of the contents in the metering chamber 22 and milks it through the valve portion 24. The contents flow from the opened end of the discharge passageway 26 and the user can catch it with the same hand. As the fingers milking the product from the container 10 are removed from the end of the valve portion 24, the valve reassumes its curled conformation, sealing the container 10 across the bottom end of the metering chamber 22. Gravity then refills the metering chamber 22 and thereby readies the container 10 for the next use cycle.

In yet another embodiment of the present invention a self-curling container may be formed from flat film in the manner described herein. In the in-use embodiment illustrated in FIGS. 3 and 4, a self-curling container 110 of the present invention incorporates a curled valve portion 124 of the type disclosed in connection with FIGS. 1 and 2 in its discharge spout 120. A slotted gate member 130 is preferably applied to the end of the container opposite the curled valve portion 124. The slotted gate member may, for simplicity, comprise a dowel having a slot 131 located parallel to its longitudinal axis. The length of the slot 131 must be sufficient to span the opposing seams 116 located along the body portion 118 of the dispensing container 110, while the width of the slot 131 in the gate member 130 is preferably substantially equal to the thickness of the body portion when empty, i.e., the thickness of the two opposing sidewalls 112 and 114 of supple imperforate material. Thus, the slot 131 exhibits sufficient friction against the walls 112, 114 of the body portion 118 of the container that it remains in place as the body portion 118 of the taut container is squeezed to express product through the valve portion 124. The gate member 130 is preferably slidable along the entire length of the dispensing container 110 in the direction of the curled valve portion 124 of the spout 120 to advance the fluid to be dispensed toward the valve and to facilitate complete emptying of the container's contents. Advancing the gate member 130 in the aforementioned manner substantially empties the end of the body portion 118 opposite the curled valve portion 124 of the spout 120. In addition, it maintains the filled portion of the container intermediate the valve 124 and the gate member 130 sufficiently taut that product can be expelled from the valve by squeezing the filled portion of the container at any point along its length. Thus, a dispensing container 110 and slidable gate member 130 of the type illustrated in FIGS. 3 and 4 is particularly well suited to situations where the user's manual dexterity is impaired, i.e., an arthritic, or to situations where the product is to be dispensed without contacting the user's skin. While a slidable gate member such as that illustrated in FIGS. 3 and 4 may be used on dispensing containers having non-curling body portions which are seamed in the flat face-to-face condition, it should be noted with respect to the embodiment of FIGS. 3 and 4 that because the opposing seams 116 securing the layers of supple imperforate material 112 and 114 to one another along the length of the body portion 118 are formed while the body portion is held over a curved surface in a manner similar to that utilized to form the curled valve portion 124, the empty body portion of the container adjacent the gate member 130 assumes a curled conformation in a manner similar to the curled valve portion 124.

The discharge spout 120 of the container 110 employs a metering chamber 122 having a passageway 126 analogous to that of the embodiment described in connection with FIGS. 1 and 2. At the discharge end of spout 120, the seams 116 converge in the discharge direction and are initially interconnected in order to close the passageway 126 off, thus forming a shipping seal which is not shown on the in-use embodiment, i.e., the consumer can open the sealed container 110 by cutting across the spout at various locations on the tapered passageway 126 near the discharge end to form an outlet 140 of desired size.

A dispensing container 110 of the type illustrated in FIGS. 3 and 4 is advantageous to facilitate dispensing of product contained therein with very little manual manipulation. The container body 118 and consequently the discharge spout 120 may be maintained in a taut condition without suspending the container so that its spout is downwardly oriented simply by advancing the gate member 130 after product has been dispensed. This facilitates a simplified dispensing operation, either as described in connection with the embodiment of FIGS. 1 and 2 or by the application of manual pressure to the filled portion of the container at any point along its length. Furthermore, for persons having difficulty with manual dexterity of their hands, i.e., persons having arthritis, the sliding gate member 130 eliminates the need to manually curl up the empty body portion 118 of the container 110 in order to facilitate dispensing through the curled valve portion 124 of the spout 120. In addition, the sliding gate member 130 permits the consumer to effectively utilize the entire contents of the container 110 without difficulty, thereby minimizing waste of the product packaged within the container. Finally, the self-curling feature of the empty body portion 118 adjacent the sliding gate member 130 maintains the package in a neat, compact, and easily storable condition throughout its useful life.

In yet another embodiment of the present invention, the self-curling feature of the empty container body 118 interacts with the sliding gate member 130 to provide a means of vertically suspending the container 110 for one-handed dispensing, as described in connection with the embodiment of FIGS. 1 and 2. In particular, the sliding gate member 130 may be affixed either temporarily or permanently to any desired vertical surface, i.e., a showerwall, by means well known in the art, i.e., the ends of sliding gate member 130 may be inserted through suction cups, 600 as shown in FIG. 10 adhesives, double-faced tapes, etc., and the end of the container opposite the curled valve portion 124 of the spout 120 merely inserted therein. The empty curled portions of the container body 118 adjacent the gate member 130 and the frictional engagement between the walls 112, 114 of the container body 118 and the slot 131 in the gate member serve to suspend the entire container 110 from the slot with its discharge spout 120 downwardly oriented. As the contents of the container 110 are discharged, the empty body portion 118 of the container 110 may be advanced through the slot 131 in the stationary gate member 130. Upon emptying of its contents, the dispensing container 110 may be readily removed from the slot 131 and a full container inserted.

Unlike the embodiment of the present invention illustrated in FIGS. 1 and 2, the seams 116 in both the spout portion 120 and the body portion 118 are made while said portions are held in a curled condition. For example, the portions can be wrapped tightly around a cylindrical mandrel, not shown, the axis of which is generally normal to the axis of passageway 126 and, thus, to the centerlines of the container walls 112, 114. Then, while the portions 120 and 118 remain wrapped and the walls 112, 114 in face-to-face contact, the seals 116 can be made in the desired manner. This causes the walls 112, 114 in the spout portion 120 and the body portion 118 to be set in the curled conformation. Thus, the valve portion 124 of the spout 120 can seal the passageway 126 below the metering chamber 122, while the body portion 118 furthest removed from the spout 120 is caused to assume a curled conformation when product is emptied therefrom by means of the slotted gate member 130, thereby permitting the plies 112, 114 to reassume a face-to-face relationship.

Product to be dispensed is maintained in the container body portion 118 intermediate the curled valve portion 124 of the spout 120 and the slidable gate member 130. Advancing the gate member 130 causes the walls 112, 114 in the spout portion 120 and the body portion 118 of the container to separate and thereby maintain an essentially straight configuration as long as product is present. The slidable gate member 130 is preferably advanced sufficiently to keep the container in a taut condition after product has been dispensed such that the desired amount of the contents can either be pinched off in the metering chamber 122 and milked through the valve portion 124 of the container 120 or expelled through the valve 124 by applying manual pressure to the filled portion of the container at any point along its length. After each dispensing operation the valve portion 124 reassumes its curled conformation sealing the container across the discharge end of the metering chamber 122.

Figure 5:
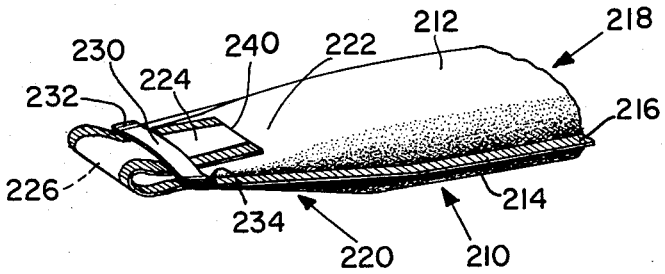
FIG. 5 is a partial perspective view of an embodiment of the present invention including means for temporarily securing the valve to the spout to prevent unwanted product discharge from a container on which the shipping seal has been opened.

If it is desired to carry a dispensing container of the present invention in a purse or suitcase after the shipping seal has been opened, any number of fasteners well known in the art, i.e., paper clips, bobby pins, etc., may be applied to the discharge end of the container to temporarily secure the valve against unwanted dispensing. As shown in FIG. 5, the valve portion 224 of a container 210 of the present invention is secured against the discharge spout 220 by means of a belt-loop style container 230 preferably formed from the same material as the container walls 212, 214 secured to the container seams 216 as at 232 and 234 by means of a heat seal or adhesive, thereby preventing the valve from uncurling to discharge product through passageway 226 and outlet 240 when pressure is inadvertantly applied to the container body 218. It is thus apparent that the particular valve securement means employed may be either integral with or independent of the dispensing container.

A dispensing container 110 of the type illustrated in FIGS. 3 and 4 may be filled by means of a filling nozzle (not shown) inserted between the walls 112, 114 at the end of the container opposite the discharge valve portion 124. Because of the container's natural tendency to assume a curled conformation, the container is preferably subjected to internally applied air pressure sufficient to cause it to assume a substantially uncurled conformation during the filling operation. The fluid product which is injected into the container 110 displaces the air which is allowed to vent. After the filling nozzle is retracted, the walls 112, 114 are thereafter closed by means of seal 116 across the end of the container opposite the discharge valve portion 124 to complete the package.

Many modifications of the above invention may be used and it is not intended to limit to the particular embodiments shown and described. The terms used in describing the invention are used in their descriptive sense and not as terms of limitation, it being intended that all equivalents thereof be included in the scope of the appended claims.

What I claim:

1. In a dispensing container for fluids comprising a body and a discharge spout which projects outwardly therefrom and wherein said spout comprises opposing walls of supple imperforate material interconnected at their lateral edges by seams which dispose the walls in substantially face-to-face contact when the spout is empty, the improvement which comprises: a valve portion of said spout in which said seams maintain said walls in a curled conformation in the discharge direction when empty to thereby provide a valving action, said walls at least in said valve portion comprising separate layers of said material, each of said layers having a radius of curvature with an axis generally normal to the centerlines of the walls of said spout when empty, said seams in said valve portion comprising a union of said separate layers in substantially face-to-face contact with one another, whereby the radius of curvature of one of said layers is greater than the radius of curvature of the other of said layers.

2. The dispensing container of claim 1 in which the spout portion includes a metering chamber intermediate the valve portion and said body to permit a desired quantity of the fluid contents to be pinched off and stripped from said spout through said valve portion.

3. The dispensing container of claim 1 in which an axis of curvature of said valve portion is generally normal to the centerlines of the walls of the spout.

4. The dispensing container of claim 3 in which the seams at the discharge end of said spout taper inwardly and are interconnected at their distal ends to form a shipping seal which can be severed at various locations along the discharge end to form an outlet of desired size.

5. The dispensing container of claim 4, including a plurality of stress concentrations located at predetermined points along the length of at least one of said seams to facilitate manual removal of said shipping seal from said dispensing container.

6. The dispensing container of claim 4, including means for temporarily securing said valve portion against said discharge spout to prevent unwanted fluid discharge through said valve portion when pressure is inadvertantly applied to said container.

7. The dispensing container of claim 3 in which the curled conformation is generally cylindrical.

8. The dispensing container of claim 3, including means for vertically suspending said container with its spout portion downwardly oriented.

9. The dispensing container of claim 8, wherein said means for vertically suspending said container comprises a suction cup.

10. A dispensing container for fluids comprising a body and a discharge spout which projects outwardly therefrom, said body and said spout comprising opposing walls of supple imperforate material interconnected at their lateral edges by seams which dispose the walls in substantially face-to-face contact when said spout and said body are empty, said dispensing container including a valve portion of said spout in which said seams in said spout area maintain said spout walls in a curled conformation in the discharge direction when empty to thereby provide a valving action of said spout, and said seams in said body area maintain the empty portions of said body in a curled conformation, said walls comprising separate layers of said material, each of said layers having a radius of curvature with an axis generally normal to the centerlines of the walls of said container when empty, said seams comprising a union of said separate layers in substantially face-to-face contact with one another, whereby the radius of curvature of one of said layers is greater than the radius of curvature of the other of said layers.

11. The dispensing container of claim 10, including a slotted gate member oriented substantially perpendicular to the direction of fluid discharge from said container, said slot having a length sufficient to span the opposing seams in said body of said dispensing container, the width of the slot in said gate member being substantially equal to the thickness of said body when empty, said gate member being slidable relative to the longitudinal axis of said body in the direction of said valve to advance the fluid to be dispensed toward said valve, thereby substantially emptying the end of said body opposite said valve and allowing said empty portion of said body to assume a curled cnformation adjacent said gate member.

12. The dispensing container of claim 11, wherein said slotted gate member is provided with securement means for affixing said gate member to a vertical surface to facilitate suspending said dispensing container therefrom.

* * * * *

UNITED STATES PATENT AND TRADEMARK OFFICE

CERTIFICATE OF CORRECTION

PATENT NO. : 4,163,509

DATED : August 7, 1979

INVENTOR(S) : JOHN S. AMNEUS

It is certified that error appears in the above-identified patent and that said Letters Patent are hereby corrected as shown below:

Column 1, line 50, "somethat" should read -- somewhat --.

Column 3, line 23, "suction cup," should read -- suction cup --.

Column 3, line 24, "9" should read -- 9, --.

Column 7, line 31, "cups," should read -- cups --.

Column 7, line 31, "10" should read -- 10, --.

Column 8, line 58, "What I claim:" should read -- I claim: --.

Column 10, line 34, "cnformation" should read -- conformation --.

Signed and Sealed this

*Twenty-fifth* Day of *December 1979*

[SEAL]

*Attest:*

SIDNEY A. DIAMOND

*Attesting Officer*

*Commissioner of Patents and Trademarks*